United States Patent [19]

Mesaros

[11] 4,075,116

[45] Feb. 21, 1978

[54] MIXED PERSALTS STABLE IN DETERGENT COMPOSITIONS

[75] Inventor: Louis Mesaros, Oullins, France

[73] Assignee: Produits Chimiques Ugine Kuhlmann, Paris, France

[21] Appl. No.: 713,430

[22] Filed: Aug. 11, 1976

[30] Foreign Application Priority Data

Sept. 15, 1975 France ..... 75 28193

[51] Int. Cl.[2] ..... C11D 7/56; C11D 7/60

[52] U.S. Cl. ..... 252/102; 252/95; 252/98; 252/99; 252/103; 252/186; 8/111; 423/467

[58] Field of Search ..... 252/99, 94, 102, 95, 252/98, 103, 186; 423/467; 8/111

[56] References Cited

U.S. PATENT DOCUMENTS

| | | | |
|---|---|---|---|
| 3,130,164 | 4/1964 | Best | 252/99 |
| 3,686,126 | 8/1972 | Smeets | 252/99 |
| 3,951,594 | 4/1976 | Smolens | 8/111 |
| 3,951,840 | 4/1976 | Fujino | 252/95 X |
| 3,979,313 | 9/1976 | Nakagawa et al. | 252/99 |
| 4,005,182 | 1/1977 | Ito et al. | 252/94 X |

*Primary Examiner*—Mayer Weinblatt
*Attorney, Agent, or Firm*—Brooks, Haidt, Haffner & Delahunty

[57] ABSTRACT

Processes for the preparation of mixed persalts capable of liberating hydrogen peroxide in aqueous solutions and stable in dry detergent compositions, which processes comprise adding 60–80% $H_2O_2$ containing 0.6–1.8% EDTA to sodium carbonate monohydrate or to a sodium carbonate hydrate containing from 75–90% sodium carbonate, wherein sodium or potassium sulfate, sodium or potassium pyrophosphate, sodium metasilicate, sodium disilicate, sodium citrate, sodium glucoheptonate, sodium perborate, anhydrous sodium carbonate, potassium carbonate, or mixed sodium and potassium carbonate or a mixture thereof is added to the reaction mixture, together with the products produced and use thereof as oxidizing agents in detergent mixtures.

9 Claims, No Drawings

MIXED PERSALTS STABLE IN DETERGENT COMPOSITIONS

BACKGROUND OF THE INVENTION

The present invention relates to processes for the preparation of mixed persalts capable of liberating hydrogen peroxide in solution, and more particularly, this invention relates to processes for the preparation of mixed persalts which are stable in the dry state in alkaline washing mixtures, as well as to the use of such persalts as oxidizing agents in alkaline detergent mixtures.

The depletion of boron minerals and the increasingly stringent standards for the prevention of pollution is compelling the manufacturers of detergent products to seek materials which can replace perborates in detergent and washing powders. Sodium percarbonate, 2 $Na_2CO_3 \cdot 3\ H_2O_2$, seems destined to be such a material, and it also possesses a further advantage over the perborate in that it dissolves more rapidly in water.

However, sodium percarbonate exhibits a drawback because it is much less stable than the perborate. As well as during its use for washing, in cartons of detergents sold at retail, and during detergent manufacture in spray towers or during the time of delivery to the manufacturer of the detergent, the sodium percarbonate undergoes decomposition, with a loss of active oxygen, very distinctly greater than the decomposition of perborate under the same conditions. The elimination of impurities, such as heavy metals, which catalyze the decomposition reaction, permits curing of the problem caused by instability of the percarbonate in all of these circumstances, with the exception of its stability in alkaline washing mixtures. While the perborate loses less than 4% of its active oxygen during four months of storage at ambient or room temperature in detergent compositions, a percarbonate which is stable under other conditions, loses at least 20% of its active oxygen.

Numerous solutions have been proposed for alleviating this stability problem of percarbonate in alkaline mixtures. Interox French Pat. applications Nos. 73/27523, 73/35424, 73/3115, and 74/2642 describe the stabilization of percarbonate by covering it with organic polymers to isolate the percarbonate particles from the other constituents of the detergent. This coating according to the Interox patents is carried out on dry percarbonate particles and involves spraying the surface of the particles with an enrobing agent, followed by drying.

DuPont French Pat. No. 2,227,320 suggests another answer to the problem, which method involves spraying a solution containing $Mg++$ ions on the powdered detergent mixture and then going on to dry it before introducing the percarbonate. The impurities which catalyze the composition of the percarbonate are themselves coated by the magnesium product by reaction between the $Mg++$ ions and the alkaline constituents of the detergent.

All of these answers to the problem are extremely costly and raise the price of the thus-stabilized detergent products to a prohibitive level. There accordingly exists a considerable commercial need to provide economical processes for the preparation of oxidizing agents which can replace perborate in detergent compositions and at the same time possess dry stability which is at least as good as that of the perborates.

THE INVENTION

The present invention provides an economical solution to the prior art problems. Briefly, the present invention provides a process for the preparation of mixed persalts which are stable in dry detergent compositions by adding hydrogen peroxide with an $H_2O_2$ content of from about 60% to about 80%, additionally containing ethylenediamine tetracetic acid (EDTA) in an amount from about 0.6 to about 1.8%, based upon 100% $H_2O_2$, to sodium carbonate monohydrate or a sodium carbonate hydrate containing from 75 to 90% of $Na_2CO_3$, wherein there is added to the reaction mixture at least one compound selected from the group consisting of sodium sulfate, potassium sulfate, sodium pyrophosphate, potassium pyrophosphate, sodium metasilicate, sodium disilicate, sodium citrate, sodium glucoheptonate, sodium perborate, anhydrous sodium carbonate, potassium carbonate, and mixed sodium and potassium carbonate.

All parts, percentages, proportions, and ratios herein are by weight, unless otherwise indicated.

The present invention is not addressed either toward the stabilization of a previously prepared sodium percarbonate or to the inhibition of the other constituents of the detergent mixtures containing the percarbonate. Rather it involves the direct preparation of oxidizing agents comprised of mixed persalts which are stable in dry detergent powders.

The proportion of the compound to be added to 100 parts of the sodium carbonate monohydrate or the stated sodium carbonate hydrate starting material is a function of the chemical nature of the composition. The amount of added compound is sufficient to obtain a mixed persalt having adequate stability. However, it is not desirable to add an excessive amount for reasons of the final manufacturing cost.

Too great a quantity of the added compound can also entail difficulties in accomplishing the purposes of this invention, as in the case, for example, where sodium glucoheptonate is used. It is equally necessary to avoid too great a reduction in the active oxygen content of the final product.

The quantities of the added compound are accordingly, in parts for each 100 parts of the carbonate starting material, desirably from about 20 to about 130 parts, and preferably from about 40 to about 70 parts for sodium sulfate and potassium sulfate; from about 4 to about 30 parts, and preferably from 6 to 12 parts for sodium pyrophosphate, potassium pyrophosphate, sodium metasilicate, sodium disilicate, sodium citrate, and sodium perborate; from 1 to 10 parts, and preferably from about two to about five parts for sodium glucoheptonate; and from about 10 to about 50 parts, and preferably from about 15 to about 30 parts for anhydrous sodium carbonate, potassium carbonate, and the mixed carbonate of sodium and potassium.

The addition of the aqueous hydrogen peroxide is carried out at a temperature of from about 20° to about 60° C and preferably from about 35° to 55° C. The time of addition is desirably from about 15 minutes to about two hours, and in certain preferred embodiments of the invention it is from one hour to 1.5 hours.

According to the cases the stabilizing compounds can be introduced before addition of the hydrogen peroxide has begun, or during or after the addition of the hydrogen peroxide.

According to one preferred embodiment of the present process, from about 0.6 to about 2% of magnesium silicate is added to the reaction mixture.

It will accordingly be understood from the present disclosure that the mixed persalts prepared according to this invention are utilized as oxidizing or bleaching agents in detergent compositions. As used herein, "detergent compositions" includes both soaps and synthetic detergents, as well as mixtures thereof.

The following examples are given to illustrate embodiments of the invention as it is presently preferred to practice it. It will be understood that these examples are illustrative, and the invention is not to be considered as restricted thereto except as indicated in the appended claims.

Outline of the Stability Test Used in the Examples

The several ingredients of the test formula, that is, the detergent powder components and the persalt mixture under test, are weighed out, and the ingredients are mixed for two or three minutes with a spatula. The mixed test composition is packed into a white box in an outer carton holding 150 $cm^3$ which is closed by an adhesive strip. The box is then weighed and numbered.

At the selected time, the box is weighed again. The contents of the box are then emptied into 1000 ml of de-ionized water at room temperature and the solution is kept for 20 minutes under agitation with a magnetic stirrer. A 50 ml portion of the stirred solution is withdrawn into a beaker containing 100 ml of 1 N sulfuric acid, and it is manganimetrically titrated under agitation by a magnetic stirrer with a 0.1 N $KMnO_4$ solution.

The original composition is tested in the same fashion. The comparison of the quantity of active oxygen in the initial composition to that of the selected sample gives the loss of active oxygen, after correction for the weight loss or gain of the detergent powder under test.

The measurements are in each instance carried out on a number of specimens of the same detergent composition. The indicated result in thus based on a statistical sampling. The ageing tests are all carried out after a one-month period in a dry, hot room at 43° C.

EXAMPLE I

Blank

This Example concerns the preparation of a basic persalt of sodium carbonate and magnesium silicate which is not part of the present invention. It is shown as a comparison formula.

A 1 $m^3$ mixer is charged with 300 kg of sodium carbonate monohydrate and after the apparatus is running 4.6 kg of magnesium silicate is added and during 115 minutes 180 kg of 68% $H_2O_2$ containing 2.3 kg of EDTA is added. The temperature of the reaction mass stays below 50° C.

The product obtained is dried in a fluidized bed. The final product has an active oxygen content of 14.1%, a mean diameter, $\phi_M$, of 375 microns, and an apparent loose (that is, untamped) density, $d_a$, of 0.85 g/$cm^3$.

EXAMPLE II

A mixer is charged with 315 g of anhydrous sodium sulfate and 250 g of sodium carbonate monohydrate, and 146.5 g of a hydrogen peroxide solution containing 1.9 g EDTA is added during 30 minutes. The temperature of the powder, wet at the end of the operation, is about 30° C. The product is subsequently dried in air.

There is obtained 634 g of product having 7.68% active oxygen, comprising particles with a mean diameter, $\phi_M$, of 430 microns and an apparent loose density, $d_a$, of 0.785 g/$cm^3$.

EXAMPLE III

A mixer is charged with 11.8 g of sodium pyrophosphate, $Na_2H_2P_2O_7$, and 250 g of sodium carbonate monohydrate. During a 30-minute period, 146.5 g of sodium peroxide solution containing 1.9 g of EDTA is added. The product so obtained is air-dried.

The active oxygen content of the final dried product is 14.4%. The mean particle diameter, $\phi_M$, is 410 microns, and the apparent loose density is 0.790 g/$cm^3$.

EXAMPLE IV

We operate as in example II but instead of sodium sulfate we use 12.6 g of sodium glucoheptonate which is added at the same time as hydrogen peroxide. The final product contains 14.9% active oxygen and has a $\phi_M$ of 215 microns and a d.a. of 0.747 g/$cm^3$.

EXAMPLE V

A one-cubic meter mixer is charged with 300 kg of sodium carbonate monohydrate, and during 115 minutes 180 kg of aqueous hydrogen peroxide having an $H_2O_2$content of 68% and containing 2.3 kg of EDTA is added. The temperature of the reaction mass does not exceed 50° C. Thereafter, 40 kg of anhydrous sodium carbonate is added, and the product is dried in a fluidized bed.

The final product contains 12.2% active oxygen and has a $\phi_M$ of 445 microns and a $d_a$ of 0.910 g/$cm^3$.

EXAMPLE VI

A one-cubic meter mixer is charged with 300 kg of sodium carbonate monohydrate and 180 kg of 68% aqueous hydrogen peroxide solution containing 2.3 of EDTA is added. At the ninetieth minute of peroxide addition, after addition of 80% of the total amount of the peroxide, 40 kg of very fine sodium perborate recovered by dust-removal from the air from industrial driers is added. The total amount of aqueous hydrogen peroxide is fed during 115 minutes. The final product is dried in a fluidized bed.

The final product contains 14.6% active oxygen and has a $\phi_M$ of 368 microns and a $d_a$ of 0.880 g/$cm^3$.

Detergent compositions containing 2.5% active oxygen are made from the persalts of Examples I through VI and the detergent ingredients shown in Table II.

The stabilities of these mixtures are determined utilizing the stability test described above on compositions containing 50 g of detergent powder A or B and about 10 g of the mixed persalts prepared in Examples I through VI.

The results of the stability tests so made are summarized in Table I below.

TABLE I

| Example | Soap powder A | Detergent B |
|---|---|---|
| | Percent loss of active oxygen | |
| I (Blank) | 47.2 | 26.8 |
| II | 27.8 | 9.8 |
| III | 23.4 | 10.8 |
| IV | 25.7 | 10.4 |
| V | 21.6 | 10.1 |
| VI | 19.5 | 8.9 |

TABLE I-continued

| Example | Soap powder A | Detergent B |
|---|---|---|
| | Percent loss of active oxygen | |
| Sodium perborate* | 7 | 5 |

*The perborate tested for comparison being prepared according to the process shown in Produits Chimiques Ugina(Kuhlmann French Patent Application 71/900, filed January 13, 1971.

TABLE II

| Ingredient | Detergent A | Detergent B |
|---|---|---|
| Phosphates | | |
| tripolyphosphate | 48.7% | 30.4% |
| pyrophosphate | 9.8 | 4.0 |
| orthophosphate (disodium) | 1.0 | 1.0 |
| metaphosphate | — | 12.0 |
| Surfactants | | |
| soap | 9.7 | 13.5% |
| sulfonates | — | |
| nonionic | — | |
| Sodium Silicate | 11.2 | 5.3 |
| Sodium Sulfate | 6.5 | 7.25 |
| Sodium Carbonate | 3.7 | 2.65 |
| Water | To make 100% | To make 100% |

What is claimed is:

1. A process for the preparation of sodium chloride-free mixed persalts capable of liberating hydrogen peroxide in aqueous solution and stable in dry alkaline mixtures, which process comprises adding aqueous hydrogen peroxide containing from 60 to 80% $H_2O_2$ and 0.6 to 1.8 percent, based upon 100 percent $H_2O_2$, of ethylenediaminetetraacetic acid at a temperature of from 20° to 60° C to sodium carbonate monohydrate or a hydrated sodium carbonate containing from 75 to 90% $Na_2CO_3$, and adding at least one alkali metal stabilizing compound chosen from the group consisting of sodium sulfate, potassium sulfate, sodium pyrophosphate, potassium pyrophosphate, sodium metasilicate, sodium disilicate, sodium citrate, sodium glucoheptonate, sodium perborate, anhydrous sodium carbonate, potassium carbonate, and mixed sodium and potassium carbonate.

2. A process according to claim 1 wherein the compound is added to the sodium carbonate monohydrate or hydrate prior to addition of the hydrogen peroxide.

3. A process according to claim 1 wherein the compound is added to the monohydrate or hydrate during addition of the hydrogen peroxide.

4. A process according to claim 1 wherein the compound is added to the monohydrate or hydrate after addition of the hydrogen peroxide is completed.

5. A process according to claim 1 wherein from about one to about 130 parts of the compound is added.

6. A process according to claim 1 wherein from about 0.6 to about 2% magnesium silicate is added to the reaction mixture.

7. A process according to claim 1 wherein for each 100 parts of the carbonate starting material, from 20 to 130 parts of sodium or potassium sulfate; from four to 30 parts of sodium or potassium pyrophosphate or sodium metasilicate, disilicate, citrate, or perborate; from one to ten parts of sodium glucoheptonate; or from ten to 50 parts of anhydrous sodium carbonate, potassium carbonate, or the mixed carbonate of sodium and potassium are added.

8. A mixture of persalts prepared according to the process of claim 1.

9. A method of using the persalt mixtures of claim 8 as oxidizing agents, which method comprises admixing an effective amount of at least one of the persalt mixtures with at least one anionic or nonionic surfactant.

* * * * *